US006108861A

United States Patent [19]

Vystrcil et al.

[11] Patent Number: 6,108,861

[45] Date of Patent: Aug. 29, 2000

[54] EXTENDABLE HOSE FOR A VACUUM CLEANER

[75] Inventors: Robert A. Vystrcil, West Farmington; Mark E. Cipolla, Chardon; Charles J. Thur, Broadview Heights; Jeffrey M. Kalman, Cleveland Hts.; Michael F. Wright, Stow; Robert A. Salo, Mentor, all of Ohio

[73] Assignee: Royal Appliance Mfg. Co., Cleveland, Ohio

[21] Appl. No.: 09/083,353

[22] Filed: May 22, 1998

Related U.S. Application Data

[63] Continuation-in-part of application No. 08/781,721, Jan. 10, 1997, Pat. No. 5,797,162, which is a continuation-in-part of application No. 08/568,174, Dec. 6, 1995, abandoned

[60] Provisional application No. 60/009,856, Jan. 16, 1996.

[51] Int. Cl.[7] ..... A47L 5/32

[52] U.S. Cl. ..... 15/323; 15/315; 15/334; 15/410

[58] Field of Search ..... 15/315, 323, 334, 15/410

[56] References Cited

U.S. PATENT DOCUMENTS

| | | | |
|---|---|---|---|
| 1,217,817 | 2/1917 | Peters | 15/335 |
| 2,196,459 | 4/1940 | Forsberg | 285/7 |
| 2,343,056 | 2/1944 | Harlett | 15/410 |
| 2,867,833 | 1/1959 | Duff | 15/323 |
| 2,953,806 | 9/1960 | Walker | 15/315 |
| 3,244,437 | 4/1966 | Belicka et al. | 285/7 |
| 3,351,359 | 11/1967 | Ferraris | 285/7 |
| 3,568,240 | 3/1971 | Hamrick | 15/315 |
| 4,050,113 | 9/1977 | Wright et al. | 15/315 |
| 4,079,965 | 3/1978 | Moughty et al. | 285/7 |
| 4,376,322 | 3/1983 | Lockhart et al. | 15/323 |
| 4,610,048 | 9/1986 | Ishihara et al. | 15/344 |
| 4,704,765 | 11/1987 | Ataka | 15/323 |
| 4,955,106 | 9/1990 | Stein et al. | 15/335 |
| 5,117,533 | 6/1992 | Stuller | 19/64.5 |
| 5,617,611 | 4/1997 | Wörwag | 15/323 |
| 5,797,162 | 8/1998 | Vystrcil et al. | 15/323 |

*Primary Examiner*—Theresa T. Snider

*Attorney, Agent, or Firm*—Fay, Sharpe, Fagan, Minnich & McKee, LLP

[57] ABSTRACT

An upright vacuum cleaner includes a housing having a suction motor and a filter chamber. A floor nozzle is connected to the housing. A hose, which communicates with the filter chamber, includes a first end, an intermediate portion and a second end. A wand, which has a first end and a second end, is selectively mounted on the housing. At least a part of the hose intermediate portion extends longitudinally through the wand from the first end to the second end. The hose first end is secured to the wand first end. A connector assembly is secured on the hose second end. When the wand is selectively mounted on the housing, a section of the hose intermediate portion is stowed in the wand. When the wand is spaced from the housing, the section of the hose intermediate portion is pulled out of the wand.

20 Claims, 11 Drawing Sheets

EXTENDABLE HOSE FOR A VACUUM CLEANER

BACKGROUND OF THE INVENTION

This is a continuation-in-part of U.S. patent application Ser. No. 08/781,721, filed on Jan. 10, 1997 , now U.S. Pat. No. 5,797,162 which is a continuation-in-part of U.S. patent application Ser. No. 08/568,174, filed on Dec. 6, 1995 now abandoned, and a continuation-in-part of U.S. Provisional patent application Ser. No. 60/009,856, filed Jan. 16, 1995.

This invention relates to vacuum cleaners. More particularly, the invention relates to a suction hose having a portion which can be stored in a wand when not needed and can be pulled out of the wand when the wand is in use.

The invention is especially suited for use with a wand which can be stored on a vacuum cleaner. It should, however, be appreciated by those of average skill in the art that the invention could also be used in various other environments where extendable length conduits are employed.

One problem with conventional vacuum cleaners is that when the vacuum cleaner is used for auxiliary vacuuming operations, the vacuum hose which connects an auxiliary tool, such as a brush or a crevice tool, to the suction inlet of the vacuum cleaner is relatively short. While hose extensions are provided, oftentimes they are not employed simply because it is inconvenient and tedious to connect hose sections together so as to have a suitable length of hose to allow a person to perform the desired auxiliary vacuuming operations.

Various types of telescoping wand assemblies are known for both upright vacuum cleaners and for canister vacuum cleaners. Several of these can be telescopically adjusted and latched at one of a number of preset positions. Such wands are disadvantageous from the standpoint that only a limited number of preset lengths of wand are available. Other types of known telescoping wand assemblies enable an infinite adjustment of the wand by providing a means for locking which enables two wand sections to be locked together at any point along their length. However, the known assemblies of this nature involve the use of several additional parts making such wand assemblies disadvantageous from the standpoint of complexity and cost due to the extra parts involved. Also, all of these known wands are rigid.

It is known that one can store a vacuum hose in a permanently installed type vacuum system so that the hose is ready for withdrawal for use when required. It is also known to temporarily store a hose section in an external hose storage tube of a canister type vacuum cleaner when the hose is not needed. However, neither of these constructions is suitable for use in an upright vacuum cleaner.

Also known is an upright vacuum cleaner having a detachable vacuum hose which is coupled to a hand held wand. The vacuum hose has a first end that can telescope into the wand from a first end thereof to a second end thereof for storage when the wand is not needed. The hose can be pulled out of the wand until the hose first end contacts the wand first end for use in auxiliary cleaning operations. However, this design is disadvantageous from the standpoint that it is expensive to manufacture. Sealing problems may also be experienced as the hose first end slides in the wand between the ends of the wand.

Accordingly, it has been considered desirable to develop a new and improved extendable hose construction for a vacuum cleaner which would overcome the foregoing difficulties and others while providing better and more advantageous overall results.

BRIEF SUMMARY OF THE INVENTION

In accordance with the present invention, a new and improved vacuum cleaner is provided.

More particularly in accordance with this aspect of the invention, the vacuum cleaner comprises a housing having a filter chamber, and a hose including a first end, an intermediate portion and a second end. A tubular wand is selectively mounted on the housing. The wand has a first end and a second end. The hose intermediate portion extends longitudinally through the wand from the wand first end through the wand second end. The hose first end is fastened adjacent the wand first end. A connector assembly is secured on the hose second end. When the wand is mounted on the housing, a section of the hose intermediate portion is stowed in the wand. When the wand is spaced from the housing, the section of the hose intermediate portion is pulled out of the wand.

According to another aspect of the invention, an extendable hose assembly for a vacuum cleaner is provided.

More particularly in accordance with this aspect of the invention, the extendable hose assembly comprises a hose including a first end, an intermediate portion and a second end. A wand is selectively mounted on the housing. The wand has a first end and a second end. The hose intermediate portion extends longitudinally through the wand from the wand first end toward the wand second end. The hose first end is secured to the wand adjacent its first end. A hose connector assembly is spaced from the wand second end. The hose second end is secured to the hose connector assembly. When the wand is mounted on the vacuum cleaner housing, a section of the hose intermediate portion is stowed in the wand. When the wand is spaced from the vacuum cleaner housing, the section of the hose intermediate portion is pulled out of the wand.

According to still another aspect of the invention, an extendable hose assembly for a vacuum cleaner is provided.

More particularly in accordance with this aspect of the invention, the extendable hose assembly comprises a tubular wand having a first end and a second end. A hose has a first end, a second end and an intermediate portion therebetween. The hose first end is secured to the wand first end and the hose intermediate portion extends longitudinally through the wand. A connector assembly includes an inner member and outer member. The inner member has a first surface secured to the hose second end and a second surface cooperating with the outer member to mount the outer member on the inner member.

One advantage of the present invention is the provision of a new and improved vacuum cleaner.

Another advantage of the present invention is the provision of a vacuum cleaner having an auxiliary cleaning system including a wand and a hose connecting the wand to a suction inlet of the vacuum cleaner wherein a portion of the hose can be stowed in the wand when the wand is not in use.

An additional advantage of the present invention is the provision of an extendable length hose assembly which can be connected to a vacuum cleaner and can be stored on the vacuum cleaner until needed.

Still another advantage of the present invention is the provision of a wand which has a flexible hose at least partially stored therein. An intermediate portion of the hose can be pulled out of the wand to lengthen the reach of the wand. Also, when the wand is detached from the vacuum cleaner, it can be oriented in any desired angular orientation in relation to the vacuum cleaner.

Yet another advantage of the present invention is the provision of an extendable hose assembly for a vacuum cleaner including a wand and a hose that can be accommodated on a housing of the vacuum cleaner when they are not in use. The assembly can be secured either to a housing of the vacuum cleaner or to a second wand in order to extend the length of the hose or of the second wand and allow any conventional cleaning tool, such as a brush or a crevice tool, to be secured to the first end of the wand.

Still yet another advantage of the present invention is the provision of an extendable hose assembly for a vacuum cleaner including a wand, a hose which is partially accommodated in the wand, and a ring which is mounted on the hose and positioned between an end of the wand and a connector assembly mounted to a second end of the hose. The ring enables the hose to be selectively secured to a housing of the vacuum cleaner in order to prevent the hose from tipping over the vacuum cleaner as the hose is moved due to use of the wand.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
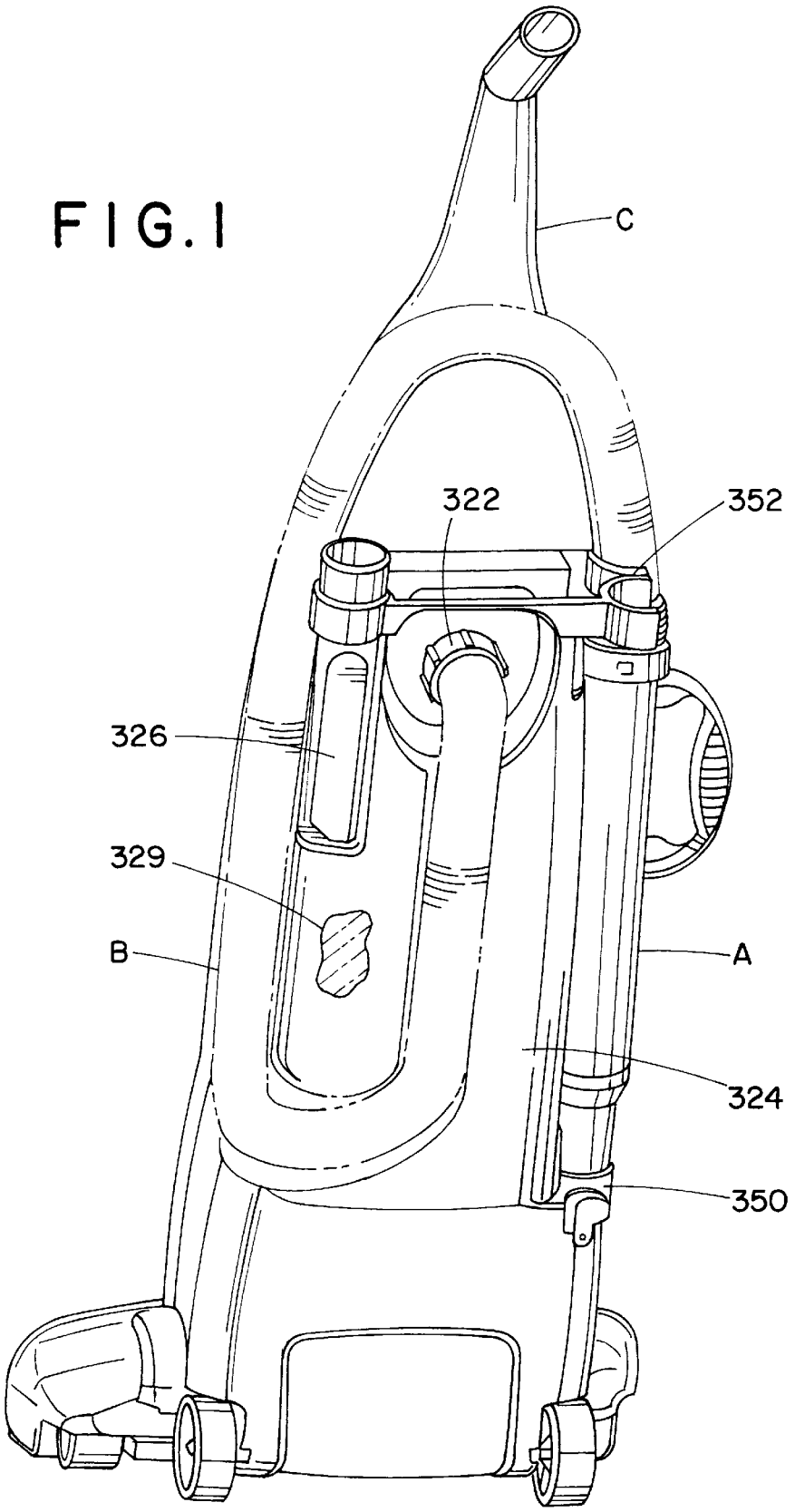
FIG. 1 is a rear elevational view of a vacuum cleaner accommodating the extendable hose construction according to the present invention in a storage position.
Figure 2:
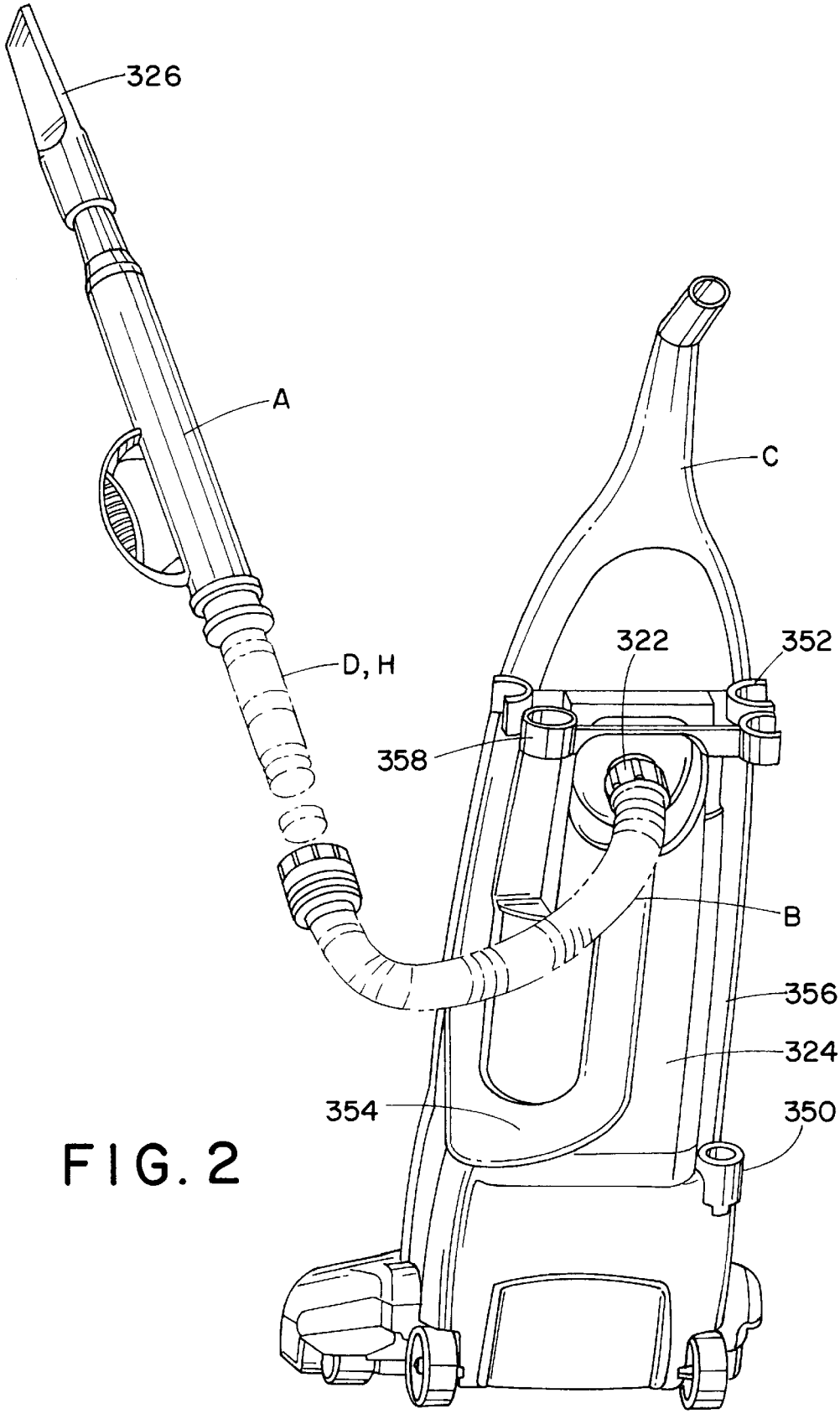
FIG. 2 is a rear elevational view of the vacuum cleaner of FIG. 1 with the extendable hose construction in an extended use position.

Referring now to the drawings wherein the showings are for purposes of illustrating preferred embodiments of the invention only and not for purposes of limiting same, FIGS. 1 and 2 show a wand assembly A which is connected to one end of an external hose B of a vacuum cleaner C. An internal hose D (FIG. 2) is housed in the wand assembly A. While the vacuum cleaner C is illustrated as being of an upright type, it should be appreciated by those of average skill in the art that the wand construction illustrated herein could also be employed for use on canister vacuum cleaners, wet/dry vacuum cleaners and in a variety of other fluid supply or fluid withdrawal environments.

Figure 4:
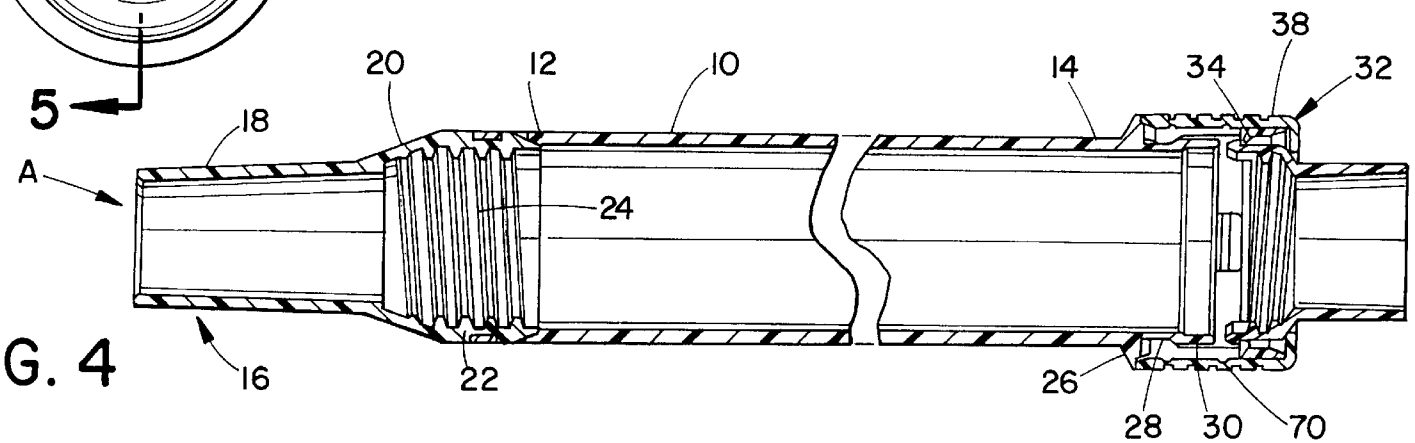
FIG. 4 is a cross sectional view of the wand assembly along lines 4—4 of FIG. 3.

With reference now to FIG. 4, the wand assembly A according to a first embodiment of the present invention, includes a tubular portion 10 having a first end 12 and a second end 14. An end member 16 is secured to the tubular portion first end 12. The end member 16 includes a first end 18 which is tapered in relation to a second end 20. The second end 20 includes a reduced diameter section 22 which is secured in the tubular portion first end 12. Located on an inner periphery of the end member second end 20 is a helical groove 24.

Figure 5:
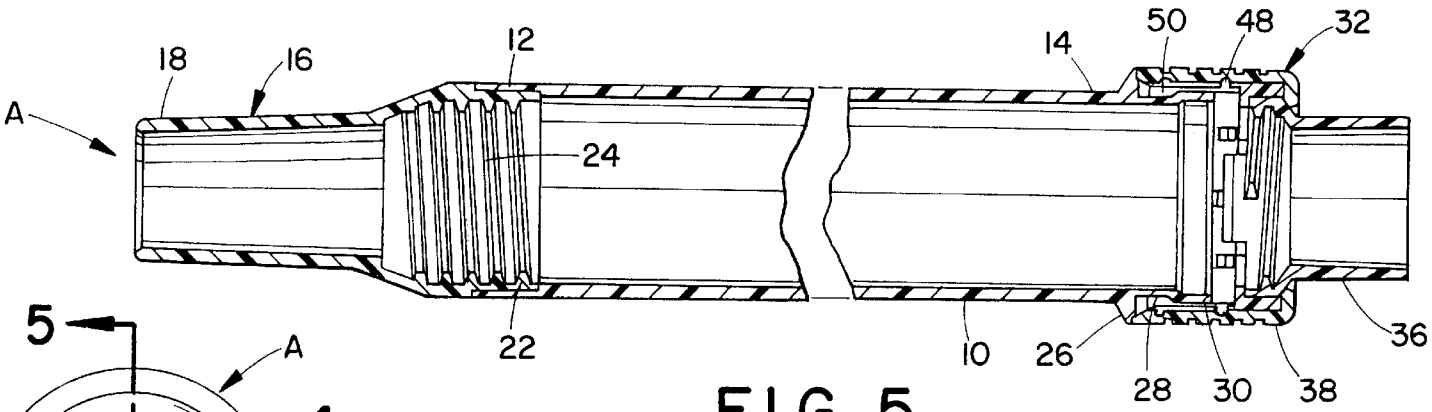
FIG. 5 is a cross sectional view of the wand assembly along lines 5—5 of FIG. 3.
Figure 3:
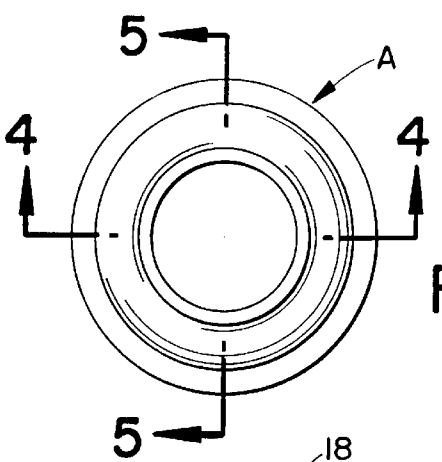
FIG. 3 is a front elevational view of an extendable wand assembly according to a first preferred embodiment of the present invention.

As illustrated in FIG. 5, located on the second end 14 of the tubular portion 10 is a flange 26. Positioned adjacent the flange 26 is a circumferential groove 28 defined in the outer periphery of the tubular portion second end 14. Located adjacent the groove 28 is a tapered shoulder 30 which forms an end edge of the tubular portion 10.

Located on the second end 14 of the tubular portion 10 is a connector assembly 32. The connector assembly 32 comprises a clip 34, illustrated in FIGS. 6–9, a hose connector 36, illustrated in FIGS. 10–14, and a housing 38, illustrated in FIGS. 15 and 16.

Figure 7:
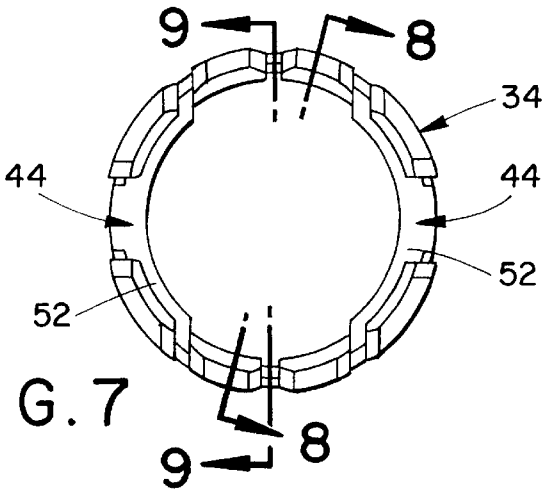
FIG. 7 is a front elevational view of the clip of FIG. 6.
Figure 8:
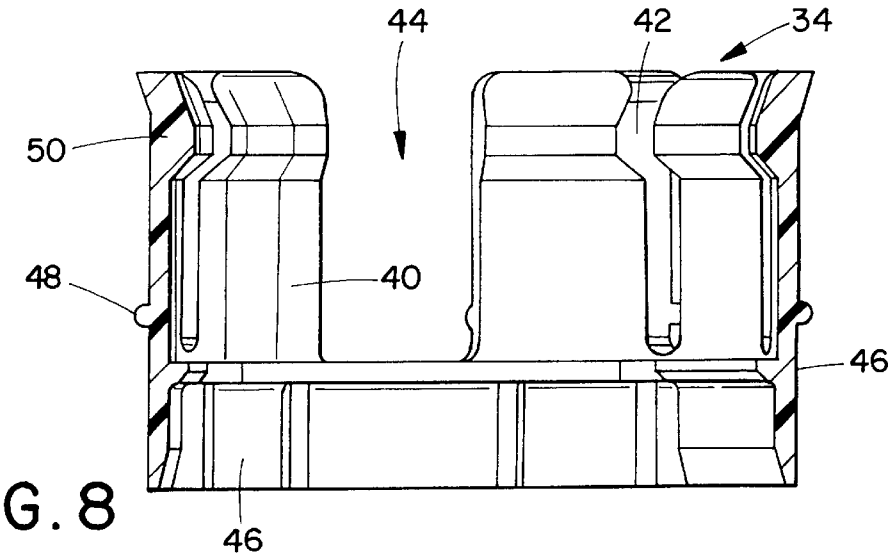
FIG. 8 is an enlarged cross sectional view of the clip along lines 8—8 of FIG. 7.
Figure 6:
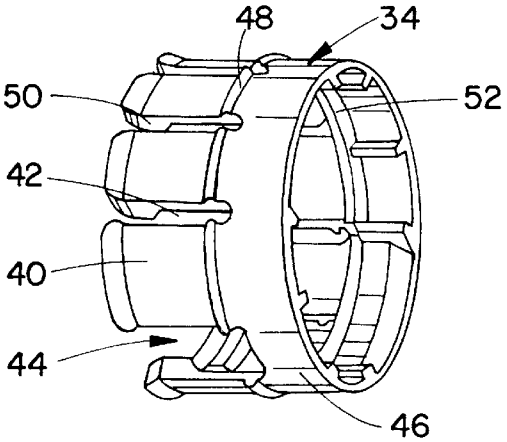
FIG. 6 is a perspective view of a clip of the wand assembly of FIG. 4.
Figure 9:
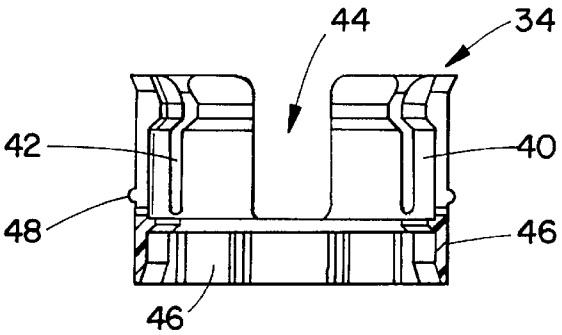
FIG. 9 is a cross sectional view of the clip along lines 9—9 of FIG. 7.
Figure 11:
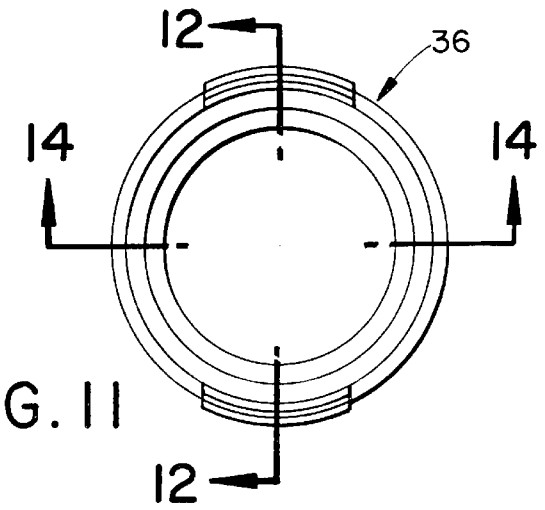
FIG. 11 is a front elevational view of the hose connector of FIG. 10.

With reference now to FIG. 6, the clip 34, which is made from a suitable resilient plastic material, includes a plurality of spaced fingers 40 separated by slots 42. Also, a pair of wide openings 44 (FIG. 9) separate groups of four fingers 40 from each other. The fingers 40 are defined on a ring 46. Located on an outer surface of each of the fingers 40 is a rib 48. Each of the fingers 40 also has a thickened free end 50 as shown in FIG. 8. Defined on an inner surface of the clip 34 are a pair of semi-circular projections 52 as shown in FIG. 7.

Figure 10:
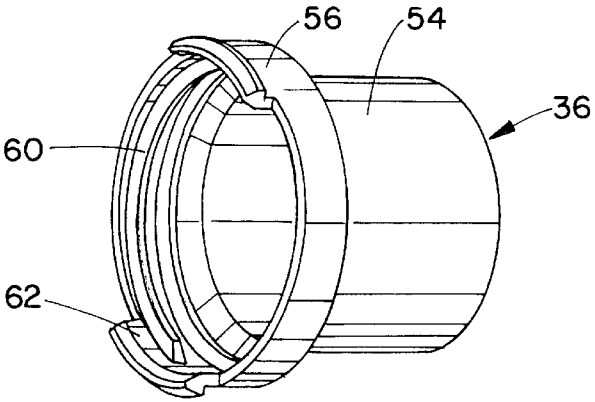
FIG. 10 is a perspective view of a hose connector of the wand assembly of FIG. 4.
Figure 13:
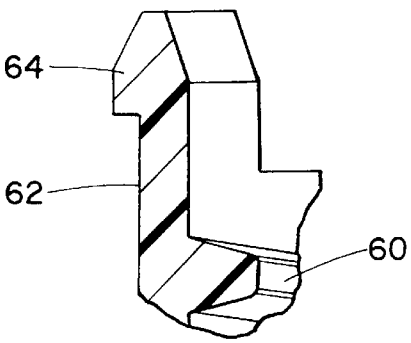
FIG. 13 is an enlarged cross sectional view of a portion of the hose connector of FIG. 12.
Figure 14:
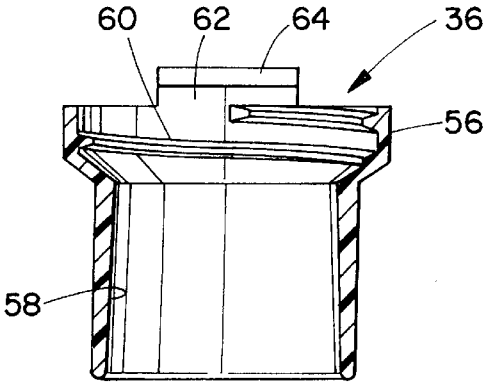
FIG. 14 is a cross sectional view of the hose connector along lines 14—14 of FIG. 11.
Figure 12:
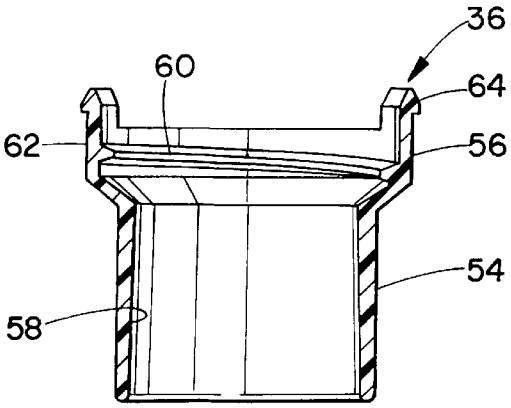
FIG. 12 is a cross sectional view of the hose connector along lines 12—12 of FIG. 11.

With reference now to FIG. 10, the hose connector 36 includes a reduced diameter end 54 and an enlarged diameter end 56. The reduced diameter end 54 has a tapered inner surface 58, as is evident from FIGS. 12 and 14. Located within the enlarged diameter end 56 is a screw thread 60. Extending from the enlarged diameter end 56 are a pair of spaced arms 62, each of which has located on an outer periphery thereof a rib 64 as shown in FIGS. 12 and 13.

Figure 16:
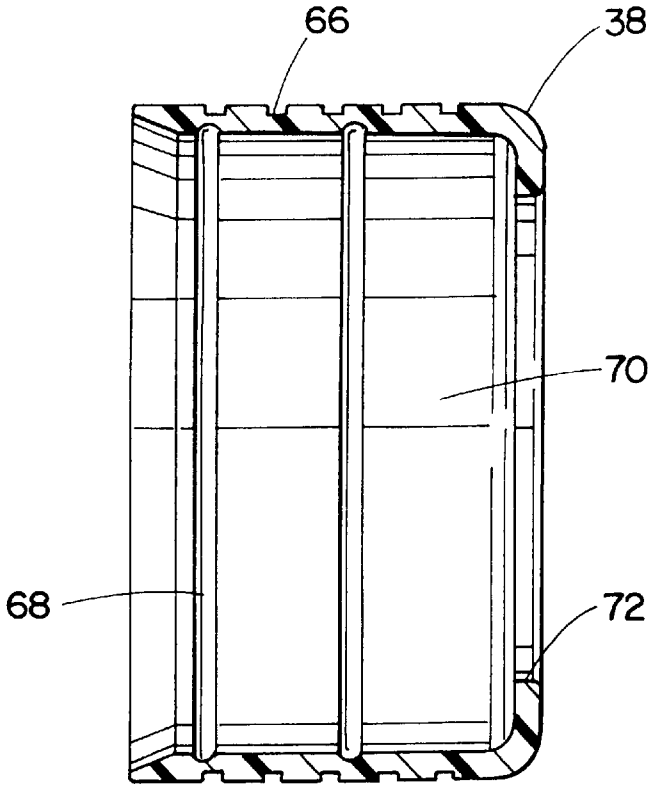
FIG. 16 is a cross sectional view through the housing of FIG. 15.
Figure 15:
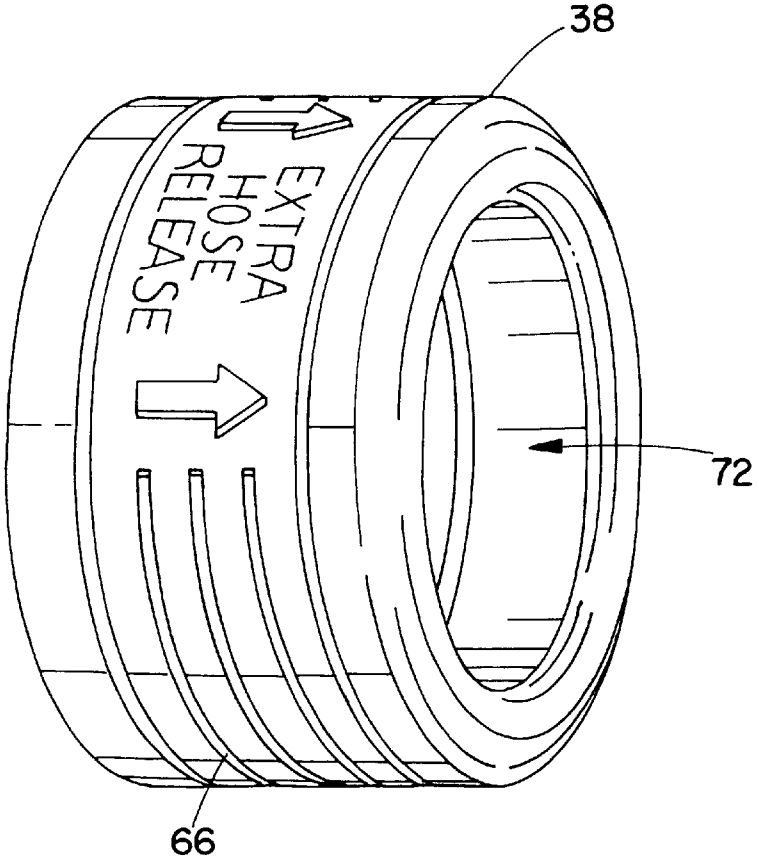
FIG. 15 is a perspective view of a housing of the wand assembly of FIG. 4.

With reference now to FIG. 15, the tubular housing 38 includes an outer periphery on which there are provided a plurality of circumferentially extending spaced grooves 66 that provide a gripping or grasping surface for the housing 38. Located on an inner periphery of the housing 38 are a pair of spaced grooves 68, 70 which extend circumferentially around the inner periphery of the housing 38, as shown in FIG. 16. It is also noted that a centrally positioned aperture 72 is located in the end wall of the housing 38.

As best shown in FIGS. 4 and 5, the ribs 48 located on the fingers 40 of the clip 34 engage in the second groove 70 of the housing 38 to lock the clip 34 in the housing 38. When the connector assembly 32 is held on the second end 14 of the tubular portion 10, the flanged free ends 50 of the fingers 40 engage in the groove 28 defined on the tubular portion second end 14. The hose connector 36 snaps into the clip 34 by the ribs 64 moving past the projections 52 so that the arms 62 are located in the wide openings 44 of the clip 34 in order to prevent a rotation of the hose connector 36 in relation to the clip 34. However, the hose connector 36 and clip 34, together, can rotate in the housing 38 as desired.

Figure 17:
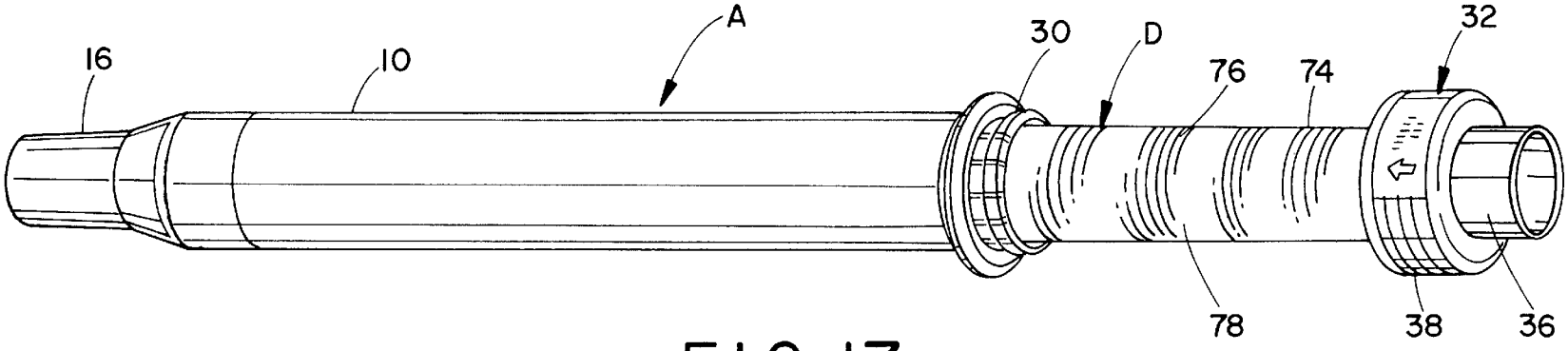
FIG. 17 is a perspective view of the wand assembly of FIG. 4 in an extended position.
Figure 18:
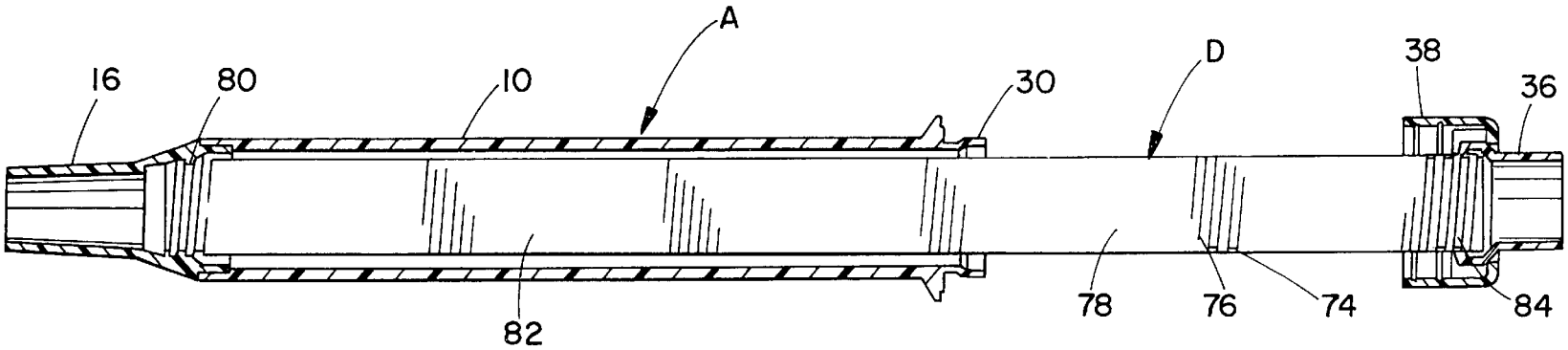
FIG. 18 is a side elevational view in cross section of the wand assembly of FIG. 17.

With reference now to FIG. 17, the wand assembly A accommodates the internal hose D which comprises a flexible, collapsible and expandable hose body 74, including a helical rib 76 between the spirals of which is defined a helical groove 78. As shown in FIG. 18, a first end 80 of the hose body 74 is secured in the helical groove 24 (FIG. 5) of the end member 16 by e.g. adhesive or the like, once the hose first end 80 has been threaded thereinto. An intermediate portion 82 of the hose body 74 is accommodated in a collapsed condition in the wand tubular portion 10. The second end 84 of the hose body 74 is held in the enlarged diameter end 56 of the hose connector 36 because the screw thread 60 thereof fits in the helical groove 78 of the hose body 74 and can be glued in place.

In a first or contracted position, the wand assembly A allows the internal hose D to be accommodated completely within the tubular portion 10 because the connector assembly 32 is secured to the second end 14 of the wand tubular member 10. When it is desired to remove the connector assembly 32 from its locked position on the second end 14 of the tubular portion 10, the operator pulls the connector assembly 32 back away from the wand assembly A. In particular, when the operator pulls on the housing 38, the housing 38 pulls the clip 34 and the hose connector 36 away from the wand second end 14. Rearward movement of the connector assembly 32 permits the internal hose D to be partially pulled out of the tubular body 10 as shown in FIG. 17. This allows the wand assembly A to be lengthened as needed.

Figure 19:
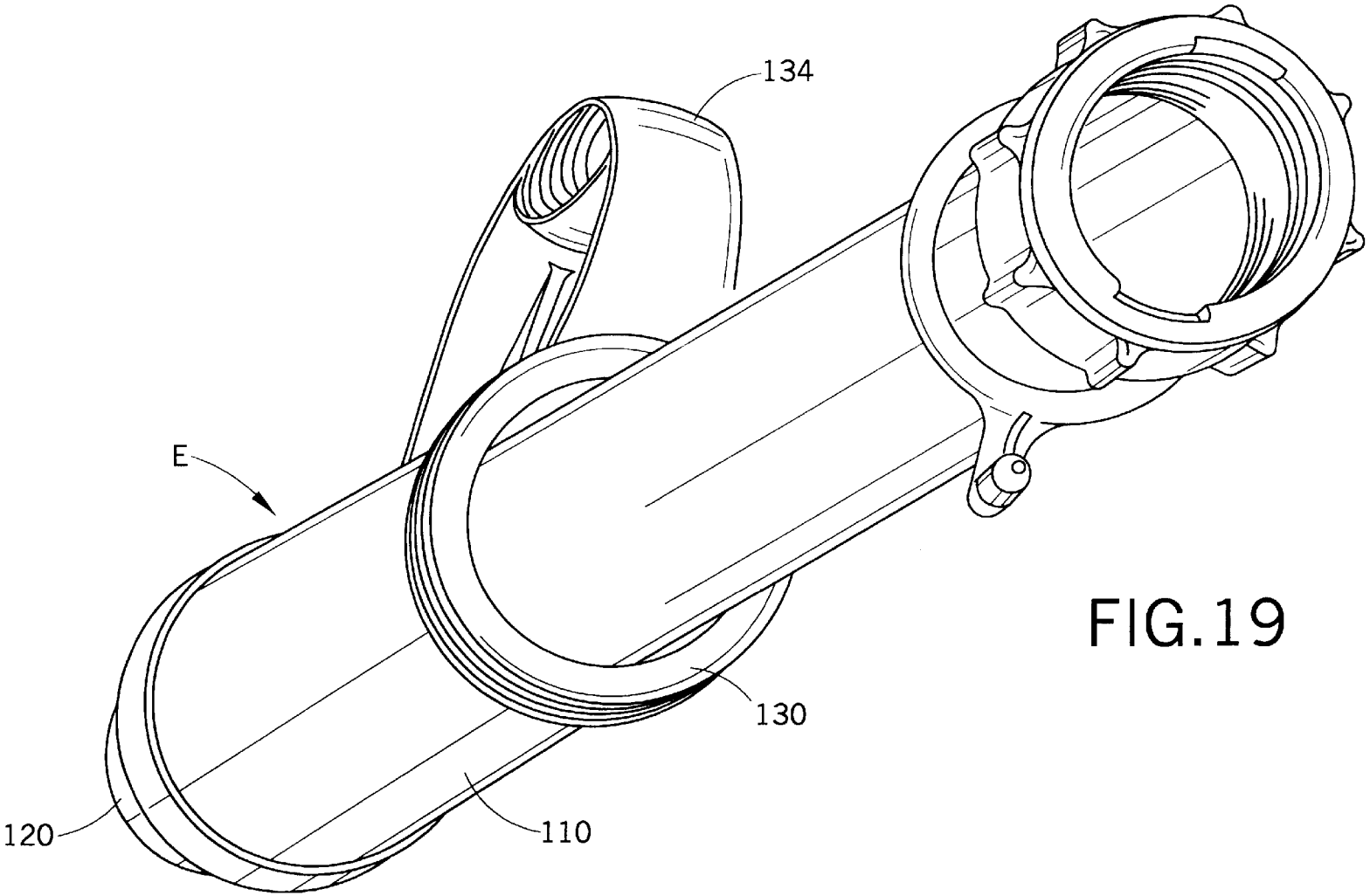
FIG. 19 is a perspective view of a hose and wand assembly according to a second preferred embodiment of the present invention.
Figure 20:
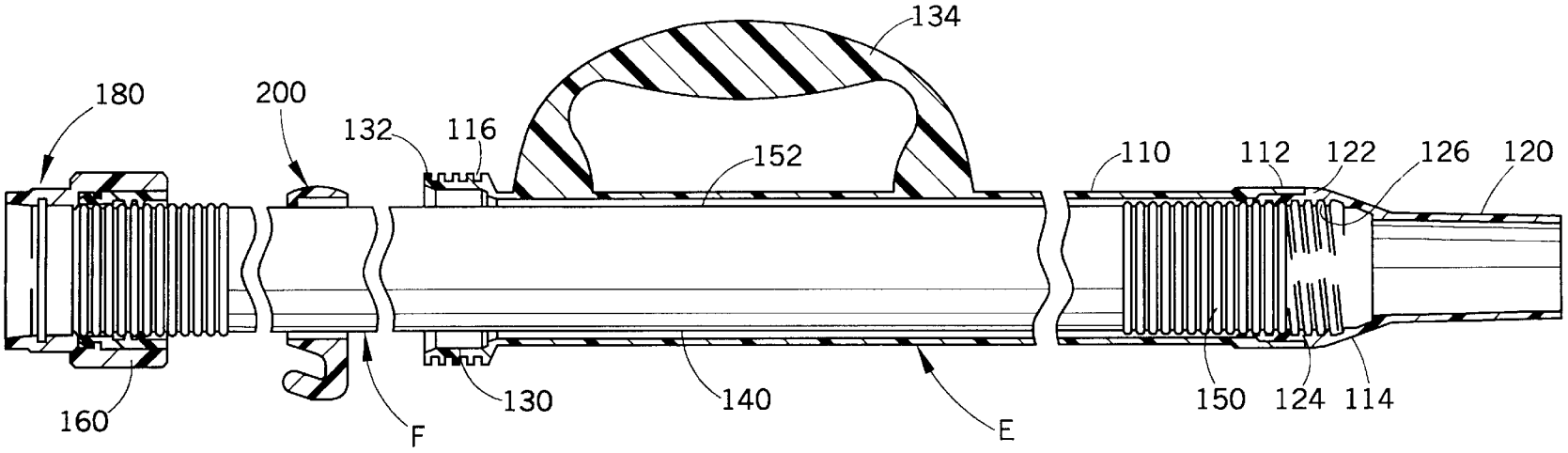
FIG. 20 is a reduced side elevational view of the hose and wand assembly of FIG. 19 taken from the right side thereof; and, FIG. 21 is an enlarged cross-sectional view of a rear portion of the hose and wand assembly of FIG. 20; and, FIG. 22 is a perspective view of an upper portion of a vacuum cleaner housing which can cooperate with the hose and wand assembly of FIG. 19.

With reference to FIG. 19, a second preferred embodiment of a hose and wand assembly E is there illustrated. With reference now also to FIG. 20, the assembly comprises a tubular wand portion 110 having a first end 112 to which an end member 114 can be secured, and a second end 116. The end member 114 includes a first portion 120 which is tapered in relation to a second portion 122. The second portion 122 includes a reduced diameter section 124 which is secured in the tubular portion first end 112. Located on the second end 116 of the tubular portion is an enlarged diameter portion 130 having outwardly extending ribs 132 which are longitudinally spaced from each other. Positioned adjacent the enlarged diameter portion 130 is a handle 134 for holding the tubular portion 110.

Figure 21:
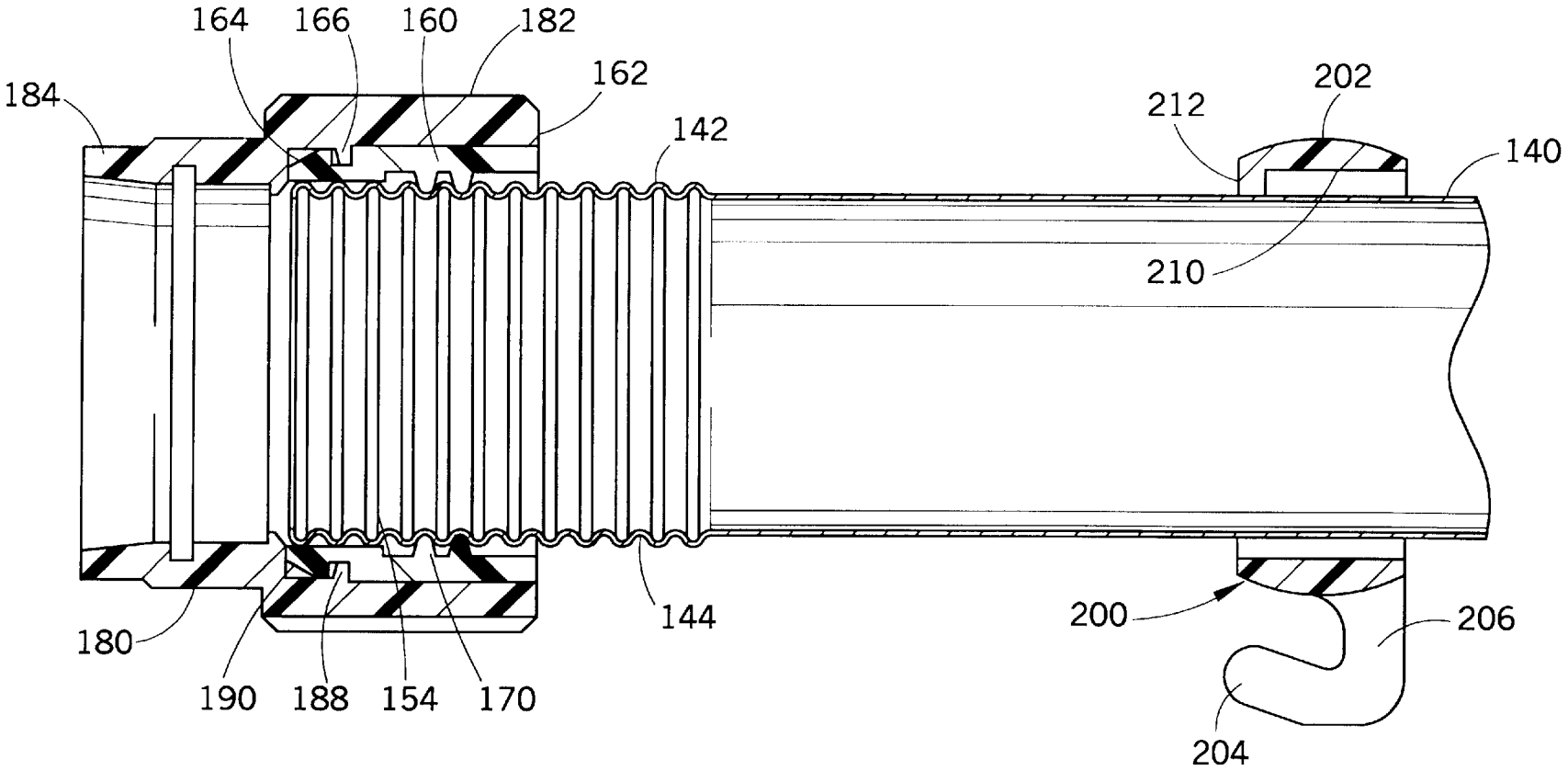

The tubular portion 110 accommodates a hose F which comprises a flexible, collapsible and expandable hose body 140. With reference now also to FIG. 21, the hose body includes a helical rib 142 between the spirals of which is defined a helical groove 144. As shown in FIG. 20, a first end 150 of the hose body 140 is secured in the helical groove 126 of the end member 114 by, e.g., adhesive or the like, once the hose first end 150 has been threaded thereinto. At least a part of an intermediate portion 152 of the hose body 140 is accommodated in a collapsed condition in the tubular portion 110. A second end 154 of the hose body 140 is held in a hose swivel 160 having a first end 162 and a second end 164. Located adjacent the second end 164 is a groove 166 defined in the outer periphery of the hose swivel. Located on an inner periphery of the hose swivel 160 is a screw thread 170 into which the hose second end 164 can be threaded. Once this is accomplished, the hose second end can be suitably secured in place via conventional adhesive or the like.

The hose swivel 160 is held in a hose connector 180. The hose connector includes a first section 182 which is of enlarged diameter in relation to a second section 184. Defined on an inner periphery of the first section 182 of the hose connector is a circumferentially extending rib 188 which snaps into the groove 166 of the hose swivel 160 once it clears a tapered end wall 190 in order to allow the hose swivel to be held in the hose connector 180.

Disposed about an exterior of the hose 140 adjacent the hose connector 180 is a ring 200. The ring has an outer periphery 202 from which projects a finger 204 mounted on a stem 206. Extending from an inner periphery 210 of the ring is a shoulder 212. The shoulder extends for only a portion of the circumference of the ring inner periphery. The purpose for the shoulder is to engage in the helical groove 144 defined between the helical ribs 142 of the hose 140. In this way, the ring can be placed in a particular position on the hose and held there. However, it is conceivable that the ring could be pulled over the ribs of the hose so as to move the ring to a different location along the length of the hose.

Figure 22:
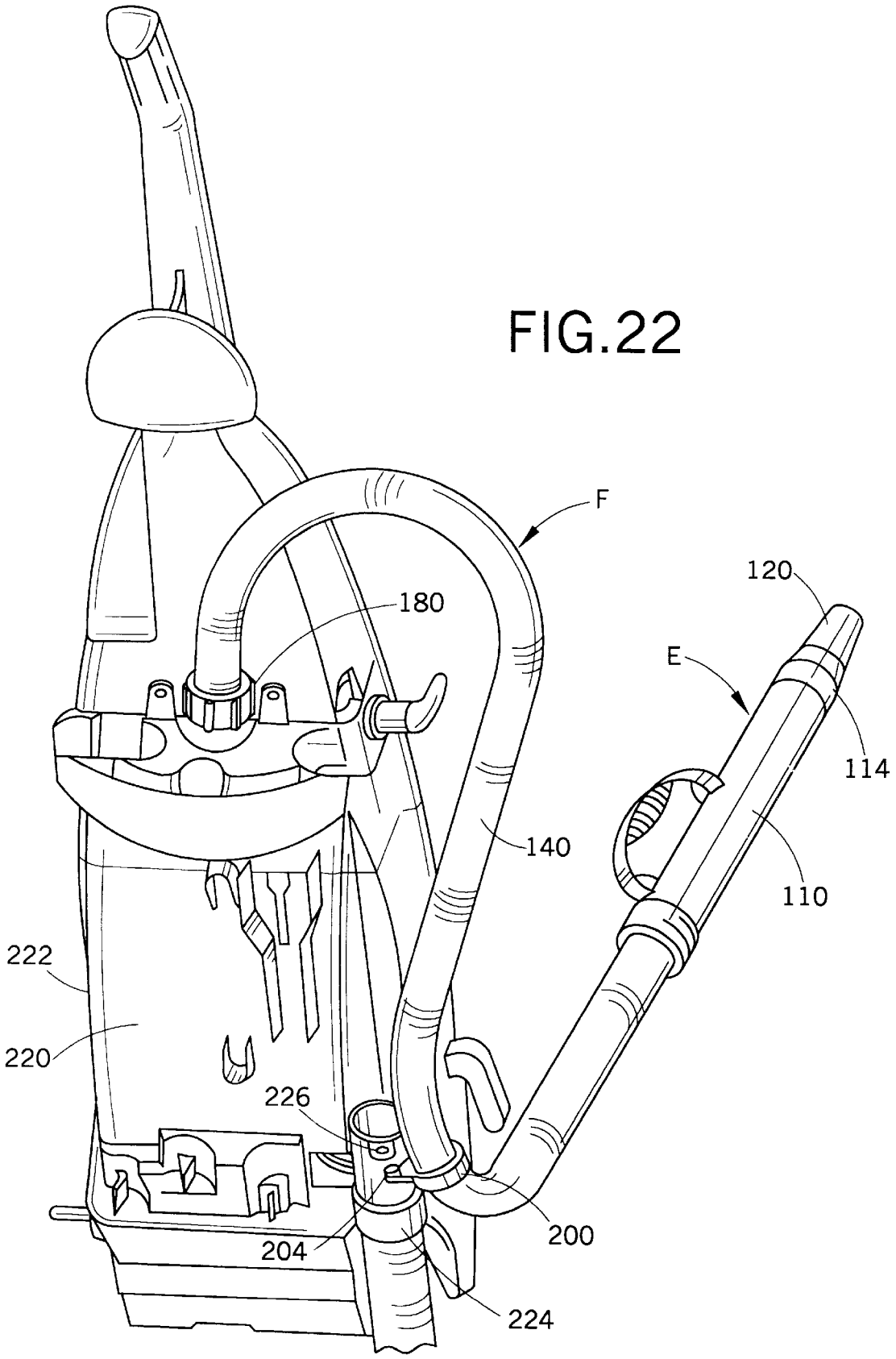

With reference now also to FIG. 22, mounted on a back wall 220 of a vacuum cleaner housing 222 is a coupling 224 having an aperture 226 which can be engaged by the finger 204 of the ring 200. The purpose for the ring is to hook the hose near the bottom of the housing 222 to prevent the movement of the hose from tipping over the vacuum cleaner as the wand is employed for above-the-floor cleaning. When, however, the hose is no longer necessary, i.e. when the wand is stowed on the housing 222, then the finger 204 is detached from the aperture 226. To complete the suction path leading from a floor nozzle of the vacuum cleaner to a filter chamber 329 (FIG. 1) thereof, the first portion 120 of the end member 114 is inserted in the coupling 224.

Because the user has to detach the finger 204 from the aperture 226 before the end member 114 can be inserted in the coupling 224, the user will put the hose F back into its original configuration on the housing 222. This will insure that the hose is not prone to clogging with dirt at bends in the hose. Such bends in the hose could occur if the hose were not properly stowed on the housing in the original configuration of the hose after use of the wand. The original hose configuration, such as is illustrated in FIG. 1, only has two smooth long-radiused curves which resist becoming clogged with dirt. It should also be recognized that the finger 204 of the ring 200 facilitates rotation and positioning of the ring at the desired location on the hose. The ring 200 can be positioned at any location on the hose between the tubular portion enlarged diameter section 130 and the hose connector 180.

With reference again to FIG. 1, located on a vacuum cleaner housing 324 is a socket 350 in which an end member of the wand A can be selectively held. Also located on the housing 324 is a support clip 352 for selectively holding a portion of the hose body B.

In FIG. 1, the wand and hose are illustrated in their storage position on the vacuum cleaner. With reference now to FIG. 2, the wand and hose are shown in their use position. In this position, the hose has now been pulled out of the wand for use. In order to do this, the connector assembly 32 is pulled away from the tubular portion second end 14. This movement enables the collapsed hose to be pulled out of the wand to its extended position. The amount of hose which can be held in the tubular portion 10 in a collapsed position can be about 11 inches of hose. When the hose is pulled out of the wand and extended, 44 inches of hose can be provided. In other words, a 4 to 1 compression of the hose can be provided via this construction.

As shown in FIG. 2, the rear surface of the housing 324 includes an indented portion 354 in which at least a portion of the circumference of the hose is accommodated. The housing rear wall also includes an indented portion 356 for accommodating the wand. Moreover, a collar 358 is provided on the housing for holding the tool 326 on the housing 324.

In contrast to the embodiment of FIGS. 1 and 2, the hose and wand assembly of FIG. 20 extends the entire length of the combination of the wand A and hose B of FIG. 1. As shown in FIG. 22, the hose connector 180 is mounted to the vacuum cleaner housing in the same location as is the hose connector 322 illustrated in FIG. 1. A large section of the intermediate portion 152 of the hose body 140 is, therefore, positioned on the vacuum cleaner housing. Only the remainder is stored within the wand tubular portion 110. In this embodiment, the hose, when fully stretched, can be about 12 to 13 feet in length. However, when it is compressed, it can be on the order of 4 to 5 feet in length.

The wand 10 and the end member 16 can be made from a suitable, relatively rigid thermoplastic material, such as ABS. Similarly, the housing 38 can be made from ABS. However, the clip 34 and the hose connector 36 can be made from a second somewhat more resilient thermoplastic material, such as acetal. The hose B is preferably made from a vinyl material for good compressibility and resilience. As is known in the hose art, there is a reinforcing rib spiralling in the hose which can be made from any suitable conventional metallic material.

In the embodiment of FIGS. 19–22, the tubular portion 110 is preferably made from a suitable conventional thermoplastic material, such as Cycolac-T. The end member 114 can similarly be made from Cycolac-T or ABS. The hose swivel 160 can also be made from ABS. The hose connector, however, is preferably made from PVC. The hose itself can be made from a suitable conventional resilient material which has good compressibility, such as a vinyl material. It should be apparent that in the embodiment of FIGS. 19–22 the hose is only secured to one end of the tubular wand portion 110. Thus the hose moves freely in the wand.

The invention has been described with reference to several preferred embodiments. Obviously, modifications and alterations will occur to others upon the reading and understanding of the preceding specification. It is intended that the invention be construed as including all such alterations and modifications insofar as they come within the scope of the appended claims or the equivalents thereof.

We claim:

1. A vacuum cleaner comprising:

a housing comprising a filter chamber;

a hose including a first end, an intermediate portion and a second end, said hose being in communication with said filter chamber;

a tubular wand selectively mounted on said housing, said wand having a first end and a second end, wherein said hose intermediate portion extends longitudinally through said wand from said wand first end through said wand second end and wherein said hose first end is fastened adjacent said wand first end; and, a connector assembly secured on said hose second end, wherein when said wand is mounted on said housing a section of said hose intermediate portion is stowed in said wand and when said wand is spaced from said housing said section of said hose intermediate portion is pulled out of said wand.

2. The vacuum cleaner of claim 1, wherein said connector assembly comprises:

an inner member which cooperates with said hose second end; and, an outer member which encircles said inner member and is secured thereto, said outer member being provided with a grasping surface.

3. The vacuum cleaner of claim 2, wherein:

said inner member includes an outwardly facing groove; and, said outer member includes an inwardly facing rib which is accommodated in said groove.

4. The vacuum cleaner of claim 2 further comprising a means for rotatably mounting said inner member in relation to said outer member.

5. The vacuum cleaner of claim 2 wherein said hose second end is fastened to said inner member and wherein said inner member comprises an inwardly extending threaded portion and said hose comprises a helically extending rib and a helically extending groove wherein said helically extending groove is received in said threaded portion of said inner member.

6. The vacuum cleaner of claim 1 further comprising a ring mounted on said hose, said ring being positioned between said wand second end and said connector assembly.

7. The vacuum cleaner of claim 6 wherein said ring comprises an outer periphery on which a finger is mounted.

8. The vacuum cleaner of claim 7 wherein said finger cooperates with an aperture formed in said housing to selectively secure said ring to said housing.

9. The vacuum cleaner of claim 7 wherein said ring comprises an inner periphery having a radially inwardly extending shoulder, wherein said shoulder engages a helically extending groove in said hose to mount said ring at a selected location along a longitudinal axis of said hose.

10. An extendable hose assembly for a vacuum cleaner, comprising:

a hose including a first end, an intermediate portion and a second end;

a wand selectively mounted on a housing of the vacuum cleaner, said wand having a first end and a second end, wherein said hose intermediate portion extends longitudinally through said wand from said wand first end toward said wand second end and said hose first end is fastened to said wand adjacent its first end; and, a hose connector assembly spaced from said wand second end, said hose second end being secured to said hose connector assembly, wherein when said wand is mounted on said vacuum cleaner housing, a section of said hose intermediate portion is stowed in said wand and when said wand is spaced from said vacuum cleaner housing, said section of said hose intermediate portion is pulled out of said wand.

11. The extendable hose assembly of claim 10, wherein said hose connector assembly comprises:

a hose swivel having a screw thread on an inner periphery thereof for engaging said hose second end; and a hose connector mounted on said hose swivel.

12. The extendable hose assembly of claim 10 further comprising a ring mounted on said hose, said ring comprising an outer periphery on which is mounted a finger, said finger cooperating with an aperture formed in said housing to selectively secure said ring to said housing.

13. The extendable hose assembly of claim 12 wherein said ring further comprises an inner periphery having a radially inwardly extending shoulder, wherein said shoulder engages a helically extending groove in said hose to mount said ring at a selected location along a longitudinal axis of said hose.

14. An extendable hose assembly, comprising:

a tubular wand having a first end and a second end;

a hose having a first end, a second end and an intermediate portion therebetween, said hose first end being secured to said wand first end and said hose intermediate portion extending longitudinally through said wand;

a connector assembly including an inner member and outer member, said inner member having a first surface secured to said hose second end and a second surface cooperating with said outer member to mount said outer member on said inner member.

15. The hose assembly of claim 14, wherein said inner member comprises a hose swivel having a first portion secured to said hose second end and a second portion secured to said outer member.

16. The hose assembly of claim 15, wherein said hose swivel first portion comprises a screw thread located on an inner periphery thereof for engaging said hose second end.

17. The hose assembly of claim 15, wherein said hose swivel includes a circumferential groove defined in an outer periphery thereof and wherein said outer member comprises a hose connector including a tubular member having an inner periphery from which extends a radially inwardly oriented rib for cooperating with said groove.

18. The hose assembly of claim 14 further comprising a ring mounted on said hose, said ring being positioned between said wand second end and said connector assembly.

19. The hose assembly of claim 18 wherein said ring comprises an outer periphery on which a finger is mounted, wherein said finger is adapted to engage an associated vacuum cleaner housing to selectively secure said ring to said associated vacuum cleaner housing.

20. The hose assembly of claim 18 wherein said ring comprises an inner periphery having a radially extending shoulder, wherein said shoulder engages a helically extending groove in said hose to mount said ring at a selected location along a longitudinal axis of said hose.

* * * * *